US007082732B2

(12) United States Patent
Titishov

(10) Patent No.: US 7,082,732 B2
(45) Date of Patent: Aug. 1, 2006

(54) INSULATED CONCRETE WALL FORMING SYSTEM AND HINGED BRIDGING WEBS

(75) Inventor: Anthony Titishov, Etobicoke (CA)

(73) Assignee: Canstroy International Inc., Etobicoke (CA)

( * ) Notice: Subject to any disclaimer, the term of this patent is extended or adjusted under 35 U.S.C. 154(b) by 336 days.

(21) Appl. No.: 10/680,395

(22) Filed: Oct. 8, 2003

(65) Prior Publication Data

US 2005/0028466 A1 Feb. 10, 2005

(51) Int. Cl.
*E04B 2/00* (2006.01)

(52) U.S. Cl. ..... 52/426; 52/565

(58) Field of Classification Search ..... 52/426, 52/565; 16/221, 29, 49, 403, 404, 405, 227, 16/229, 262, 231, 234
See application file for complete search history.

(56) References Cited

U.S. PATENT DOCUMENTS

| | | | | |
|---|---|---|---|---|
| 1,035,206 | A * | 8/1912 | Lewen | 52/422 |
| 3,286,428 | A | 11/1966 | Kay | |
| 4,698,947 | A | 10/1987 | McKay | |
| 4,730,422 | A | 3/1988 | Young | |
| 4,765,109 | A | 8/1988 | Boeshart | |
| 4,866,891 | A | 9/1989 | Young | |
| 4,879,855 | A | 11/1989 | Berrenberg | |
| 4,884,382 | A | 12/1989 | Horobin | |
| 4,889,310 | A | 12/1989 | Boeshart | |
| 4,894,969 | A | 1/1990 | Horobin | |
| 4,936,540 | A | 6/1990 | Boeshart | |
| 4,938,449 | A | 7/1990 | Boeshart | |
| 5,003,746 | A | 4/1991 | Wilston | |
| 5,107,648 | A | 4/1992 | Roby | |
| 5,154,032 | A | 10/1992 | Ritter | |
| 5,390,459 | A | 2/1995 | Mensen | |
| 5,657,600 | A | 8/1997 | Mensen | |
| 6,230,462 | B1 | 5/2001 | Béliveau | |
| 6,401,419 | B1 | 6/2002 | Béliveau | |

FOREIGN PATENT DOCUMENTS

| | | |
|---|---|---|
| CA | 826584 | 11/1969 |
| CA | 1145584 | 5/1983 |
| CA | 1182304 | 2/1985 |
| CA | 1194706 | 10/1985 |
| CA | 1209364 | 8/1986 |

(Continued)

*Primary Examiner*—Naoko Slack
*Assistant Examiner*—Jessica Laux
(74) *Attorney, Agent, or Firm*—Gowan Intellectual Property

(57) ABSTRACT

A bridging web for linking a first and second wall panel, the first and second wall panels extending parallel to one another. The bridging web has a first and second end member, each of which extend between a first edge mountable within the wall panels and a second edge. The second edge has a first hinge element. The first end member is mountable within the first wall panel and the second end member is mountable within the second wall panel. A central section extends between a pair of second hinge elements and is mountable between the first hinge element of the first end member and the first hinge element of the second end member. One of the first and second hinge elements is a pin and the other of the first and second hinge elements includes at least one first knuckle and at least one second knuckle. The pin defines a vertical hinge axis. The first knuckle is vertically displaced from the second knuckle, and the first and second knuckles are adapted to bear on opposing surfaces of the pin.

16 Claims, 16 Drawing Sheets

FOREIGN PATENT DOCUMENTS

| | | |
|---|---|---|
| CA | 1233042 | 2/1988 |
| CA | 1234701 | 4/1988 |
| CA | 1244668 | 11/1988 |
| CA | 1303377 | 6/1992 |
| CA | 1304952 | 7/1992 |
| CA | 2235426 | 11/1999 |
| CA | 2256091 | 6/2000 |
| CA | 2267633 | 6/2000 |
| CA | 2292865 | 6/2000 |

* cited by examiner

INSULATED CONCRETE WALL FORMING SYSTEM AND HINGED BRIDGING WEBS

BACKGROUND OF INVENTION

This invention relates to the field of wall-form components for building concrete walls and more specifically, bridging webs which are used to maintain wall-form panels at a specific distance in a parallel relationship to each other.

Conventionally, concrete walls are constructed first by constructing wooden wall-forms and then placing concrete into the space provided between them. Once the concrete hardens, the wooden wall-forms are removed and the walls are insulated and finished as required. This type of construction is time-consuming and wasteful in manpower and material resources. Furthermore, high energy costs for heating and cooling requires that such concrete walls have adequate thermal insulation particularly in regions of extreme climatic conditions.

As a result of continued advancements in the construction industry, many improvements have been introduced in the past several years. New construction materials and building techniques have emerged, one of which is the Insulated Concrete Forming (ICF) System. Currently there are a wide variety of different ICF systems available on the market, all of which are used for building concrete structures.

Some ICF systems currently on the market use a pair of wall-panels to construct wall-forms for the placement of concrete. The panels may remain as part of the wall insulation. The panels are often held in a spaced and parallel relationship by a number of bridging webs. The bridging webs are mounted at each end between the panels. Therefore, a right-hand and a left-hand panel need to be selected. In addition, the wall forms are pre-assembled at a factory and then transported to the construction site. Because the bridging webs may be embedded within the panels, relatively few wall forms can be transported within a given volume due to the spacing provided by the bridging webs.

U.S. Pat. No. 6,230,462 issued to Beliveau proposes an interesting solution to the problem of transporting spaced-apart wall panels. In this system, the bridging webs are composed of two identical end sections embedded within each wall form and a central section spanning the distance between the two end sections. The central section is hingedly connected to the end sections, allowing the panels to fold against one another.

One disadvantage of this system, however, is that the end sections cannot be easily formed using an injection molding process. Multiple steps are required in the injection molding process or the hinge would involve multiple pieces affixed to one another. The additional molding steps required add significantly to the costs involved in manufacturing the webs, offsetting some of the cost savings arising from reduced transportation costs.

SUMMARY OF INVENTION

The insulated wall forming system and the hinged bridging webs described herein overcome the problems described above.

Described herein is a bridging web for linking a first and second wall panel. The first and second wall panels extend parallel to one another. The bridging web includes a first and second end member. Each of the end members extend between a first edge mountable within the wall panels and a second edge. The second edge has a first hinge element. The first end member is mountable within the first wall panel and the second end member is mountable within the second wall panel.

A central section extends between a pair of second hinge elements and is mountable between the first hinge element of the first end member and the first hinge element of the second end member. One of the first and second hinge elements is a pin and the other of the first and second hinge elements includes at least one first knuckle and at least one second knuckle. The pin defines a vertical hinge axis. The first knuckle is vertically displaced from the second knuckle. The first and second knuckles are adapted to bear on opposing surfaces of the pin.

The bridging web may also include a stop member adapted to maintain the first hinge element at a fixed vertical position with respect to the second hinge element.

In one embodiment, the first hinge element is a pin, while in another embodiment, the second hinge element is a pin.

Optionally, one of the first and second hinge elements includes a plurality of first and second knuckles, where each of said first knuckles is vertically displaced from each of the second knuckles. The first and second knuckles may be positioned in a vertically alternating pattern.

The second edge of the end members may be a connecting plate, with the first and second knuckles being affixed thereto. The connecting plate may have an upper end, a lower end, a first connector mounted to the upper end and a second connector mounted to the lower end. The first connector may be adapted to connect to the second connector of an adjoining end member.

In another embodiment of the present invention, described herein is a building component having first and second panels. Each of the said panels has an inner surface and an outer surface. The first and second panels are arranged in a spaced parallel relationship with the inner surfaces facing each other. The building component includes a plurality of bridging webs, as described, extending between the panels, tying the first panel to the second panel.

The present ICF system preferably uses polystyrene panels to construct wall-forms for placement of concrete, and which remain as part of the wall insulation. The discrete elements of the ICF system (usually referred to as forms or blocks) consist of a pair of polystyrene panels, held in spaced and parallel relationship by a number of bridging webs. These blocks are arranged in stacked rows to form a hollow polystyrene wall-form for the placement of concrete. Once the concrete is placed into the cavity of the wall-form, the polystyrene panels are bonded to the hardened concrete and remain as wall insulation.

The system uses a bridging web with two end sections embedded in the wall panels and a central section hingedly connecting the end sections. The embedded end sections of the bridging webs are engineered and designed so that they can be mass-produced with a simple injection mold without a need for intermediary complicated procedures for creating a tubular section or hinge. As well, because the bridging web has two hinges, the panels can be collapsed against one another, thus reducing the volume required for transportation.

This unique design of the bridging web also makes it easy to produce wall-forms for different thickness of concrete core. Using identical polystyrene panels with identical embedded end-sections and by simply changing the size of the central web-section, one can produce a different concrete wall-form. That is, the same panels are used for the making of 100 mm concrete wall-forms, as well as 150 mm size concrete wall-form, as well as 200 mm and 250 mm concrete wall-forms, by simply inserting a different central web-section. This characteristic eliminates the need for a large variety of moulds for making different sizes of wall-form, which significantly reduces the production costs.

Also, having similar panels allows the construction of wall-forms with a variable concrete core width. That is, a wall can be constructed using 150 mm forms for one floor and then continuing with 100 mm forms for the second floor while continuously maintaining a smooth external wall surface. When the forms are stacked on top of each other, the buried web portions are aligned and arranged so that they line up to form vertically continuous rigid columns over the entire width and height of the wall-form. These rigid columns totally eliminate any settlement of the polystyrene panels due to the internal weight of concrete. The webs of each layer interlock with webs of the preceding and consecutive layer, eliminating the need to tie the layers together to prevent floating and separation during placement of concrete. Such characteristics reduce the time of the erection of wall-forms by as much as 60%.

The bridging webs in this ICF System keep the polystyrene panels in parallel attitude, providing rigidity and stability during placement of concrete. When the blocks are stacked on top of each other, the embedded web-portions are aligned and arranged so that they line up vertically to form continuous rigid columns over the entire height of the wall-form. These rigid columns eliminate any settlement of the wall panels, which may occur due to the weight of internal concrete.

The bottom and the top surfaces of the polystyrene panels have checkerboard relief (indentations and protrusions) arranged in a mirror symmetry to each other, which fit together and act as a locking mechanism to hold the adjacent rows of panels creating a smooth and solid wall-form. These indentations and protrusions of the top and bottom sides are designed with a pattern that makes them reversible. In other words, the blocks are reversible, because each side (top and bottom) is identical and interchangeable. For example, when the block is cut in half along its length, both parts are identical and interchangeable. This characteristic not only reduces significant amount of waste but also allows for making corners with any angle size.

The 90° corners are also reversible, that is, only a single corner is produced and is used interchangeably both as Right and as Left Corner simply by flipping it upside down. The System also eliminates the need to manufacture blocks with a variable type corner and the 45° corner. By cutting the standard block at half-angle of the desired corner, and flipping one side of the cut block, will produce two sections of the desired corner. For example, by cutting a standard block at an angle of 22.5° and flipping one part over, the cut block will produce a corner of 45° when the two sections are joined together at the cut surface. Similarly, a corner of any size can be made such as 30° and 60° or a corner with any odd deflection.

Because the polystyrene panels are manufactured independently and not in pairs to form a block, the mould is designed so that twice as many panels are produced by one mould. Such a mould doubles the production capacity for the same machine cycle-time while significantly reducing the manufacturing costs.

A grapnel-type hook at each end of the embedded end-section of the bridging web is in mirror symmetry of a grapnel hook of adjacent row of blocks, which interlocks with the bridging webs of the preceding and following layer of blocks into a stable wall-form unit, eliminating the need to tie the layers together to prevent floating and separation, during placement of concrete, The bridging web-assembly consists of two end-sections and a central-section. The end-sections are embedded opposite each other into each of the polystyrene panels with only the tubular section exposed. The central-section is inserted into the tubular hinge of both end-sections creating two pivoting hinges. The two hinges allow the polystyrene panels to swing, pivot and to be collapsed during transportation or storage. In this way, the volume of the forms can be reduced, allowing for about 40% more forms to be transported for the same price. The forms are assembled after the panels are expelled from the mould.

BRIEF DESCRIPTION OF DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION

The novel features which are believed to be characteristic of the present invention, as to its structure, organization, use and method of operation, together with further objectives and advantages thereof, will be better understood from the following discussion.

Figure 1A:
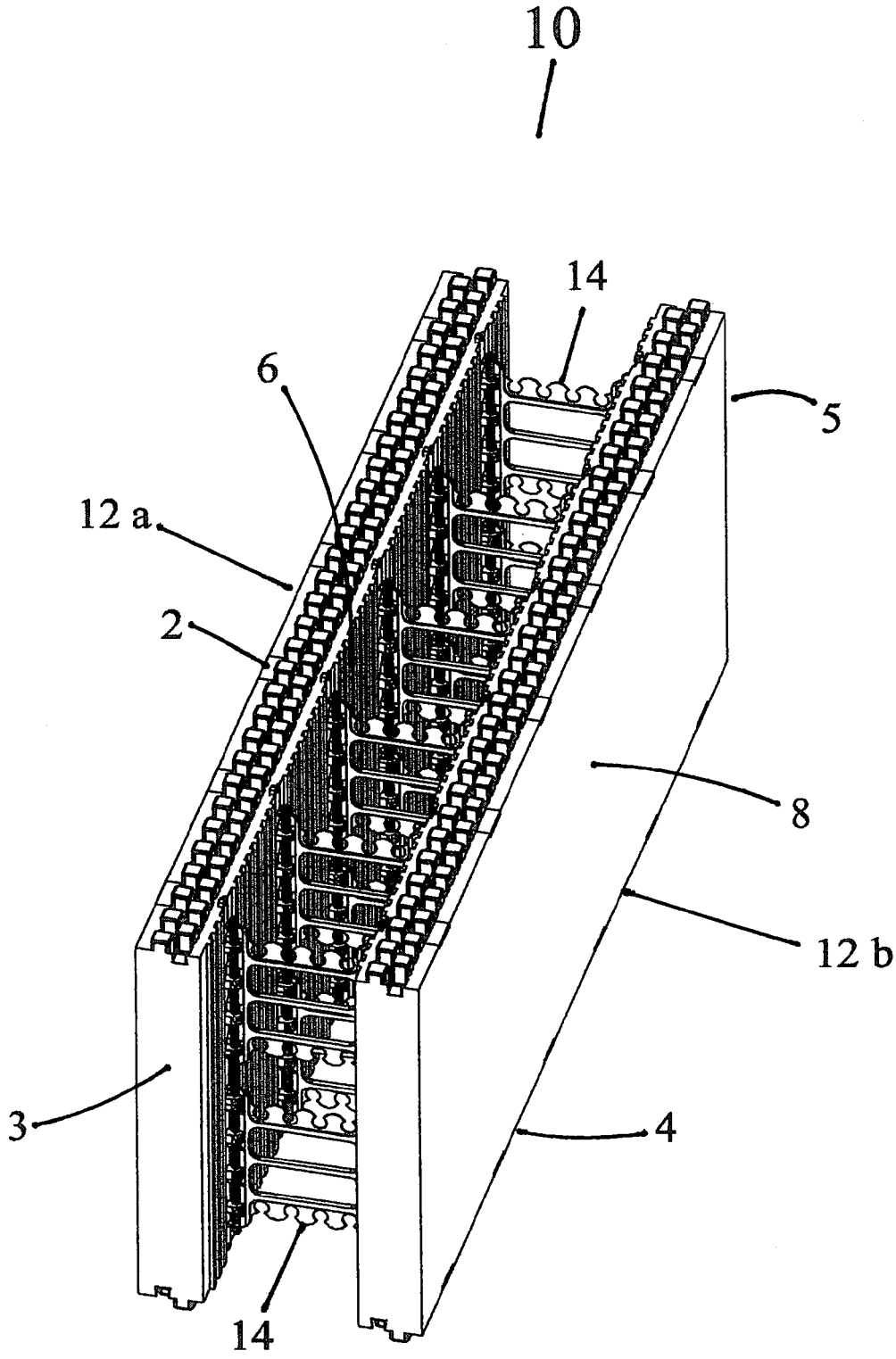
FIG. 1*a* is a representative view of the integral building component in accordance with the invention.
Figure 2A:
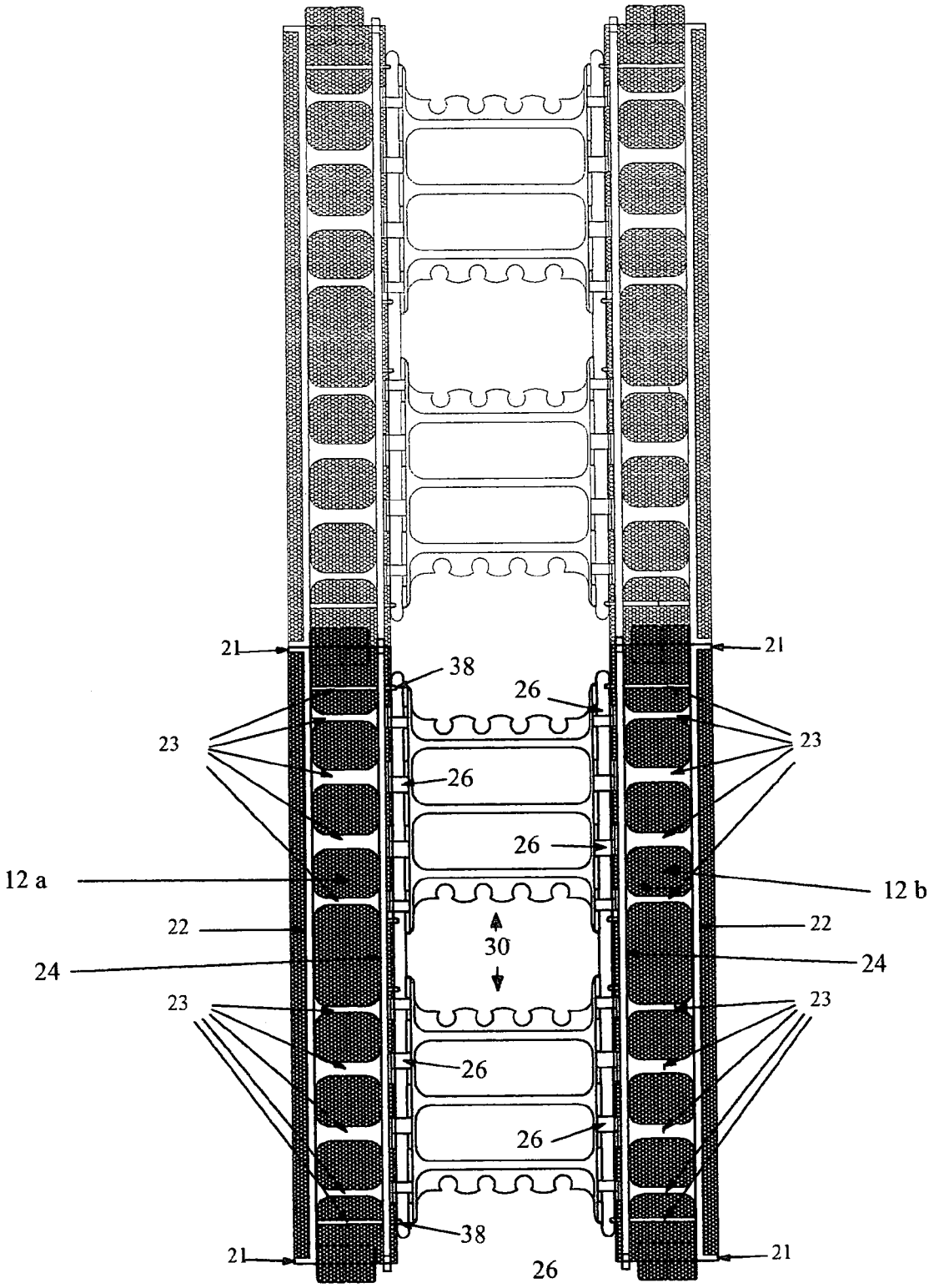
FIG. 2*a* is a cross-section of the side elevation of building component of FIG. 1*a*, showing the upper and lower rows of stacked panels.
Figure 2B:
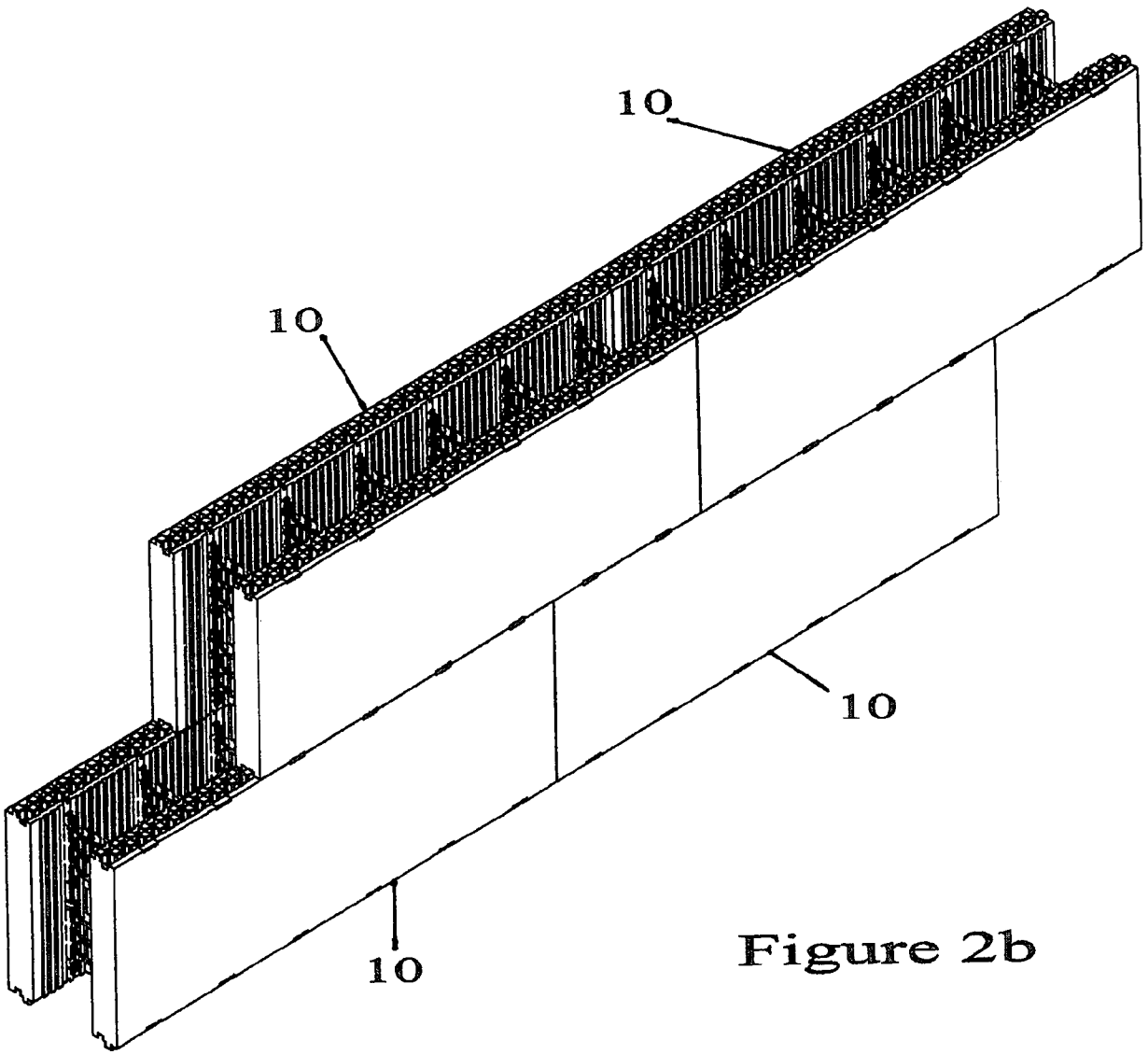
FIG. 2*b* is a perspective view of the stacked rows of two stacked rows of building components.

According to this invention, FIG. 1*a* is a representative illustration of a discrete wall-form component 10 used in building of wall-forms for placement/receiving material such as concrete. The wall-form obtained is of the type comprising a plurality of wall-form components 10 stacked vertically to form a wall as seen in FIG. 2*a* and FIG. 2*b*.

Figure 1B:
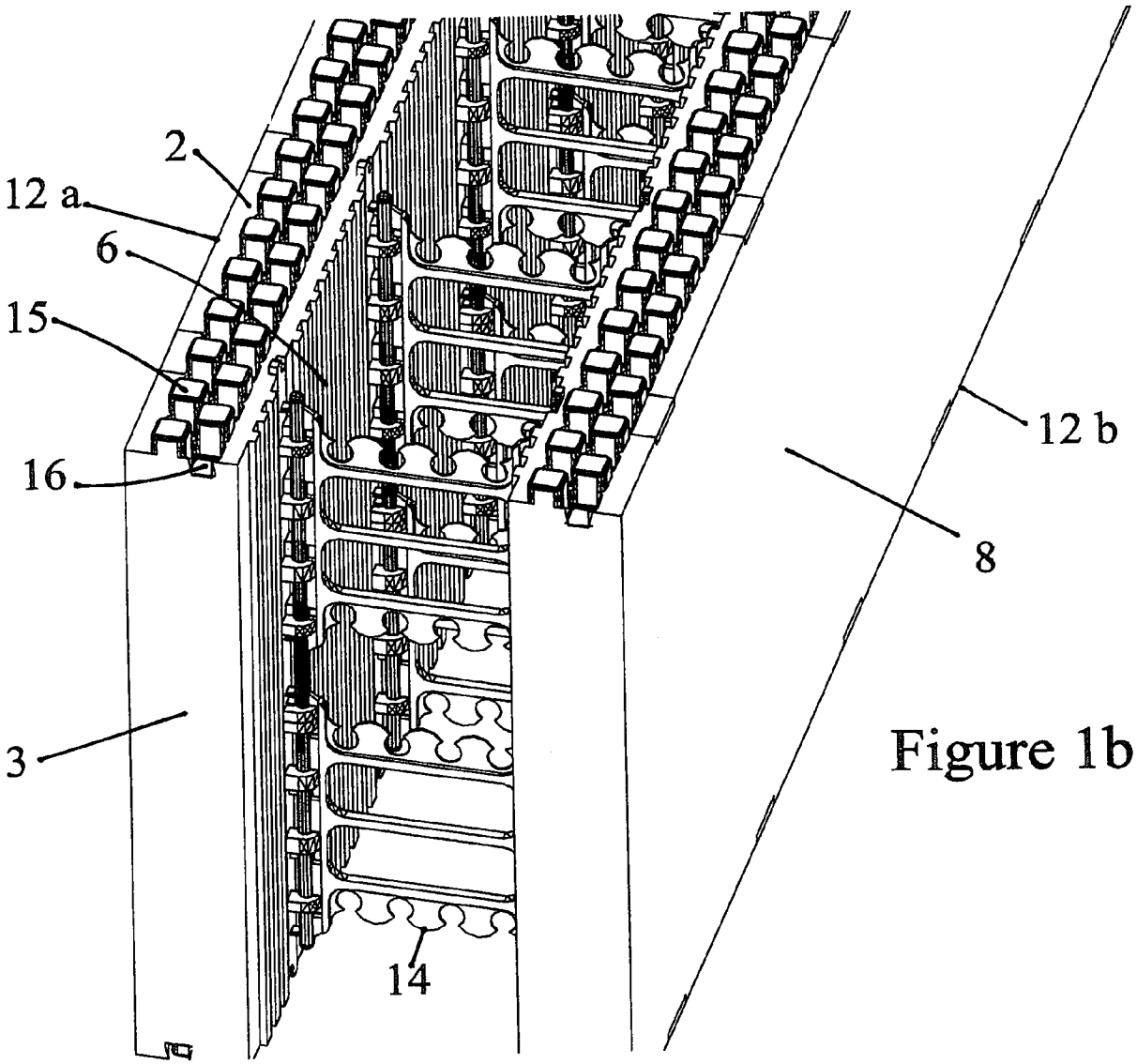
FIG. 1*b* is a perspective view showing a series of protrusions and depressions located on the top and bottom surfaces of each panel of the integral building component of FIG. 1*a;*
Figure 6:
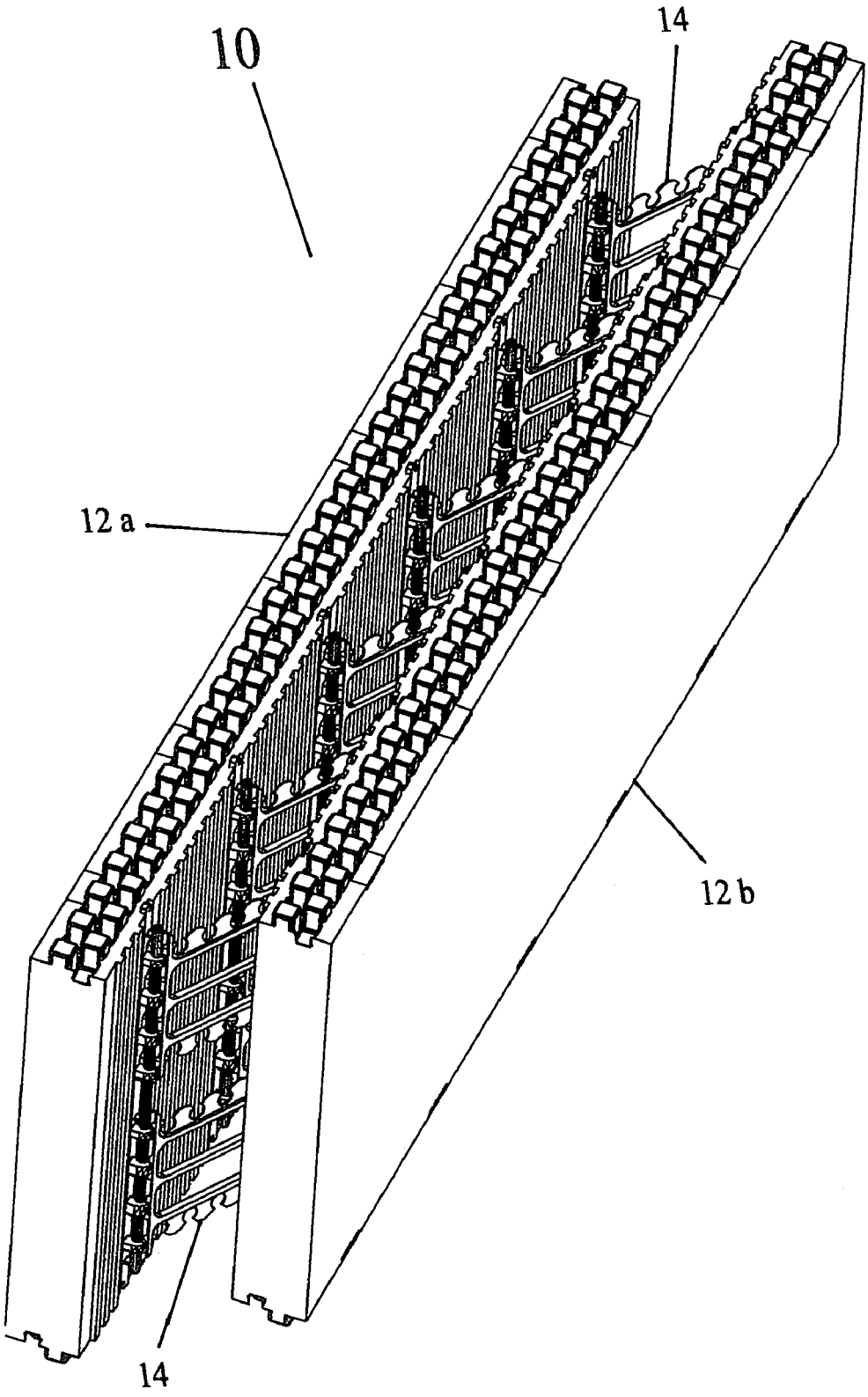
FIG. 6 is a perspective view showing the building component of FIG. 1*a* in a partially collapsed position.

The wall-form component 10 comprises a first foam panel 12*a* opposed to a second foam panel 12*b* arranged in spaced and parallel relationship, and tied together by means of a plurality of bridging webs 14. As illustrated in FIG. 1*a*, FIG. 1*b* and FIG. 6, the foam panels 12*a* and 12*b*, comprise inner and outer surfaces 6 and 8 respectively, top and bottom surface 2 and 4, respectively, and first and second ends 3 and 5. Each of the top surface 2 and bottom surface 4 have a checkerboard-type relief including alternating protrusions 15 and indentations 16. The checkerboard-type relief of the top surface 2 is in mirror symmetry with the checkerboard-type relief of the bottom surface 4 such that the top surface 2 is adapted to fit together with the bottom surface 4 of an upwardly adjacent similar foam panel 12, as shown in FIG. 2*a* and FIG. 2*b*, and the bottom surface 4 is adapted to fit together with a downwardly adjacent similar foam panel 12.

Figure 3A:
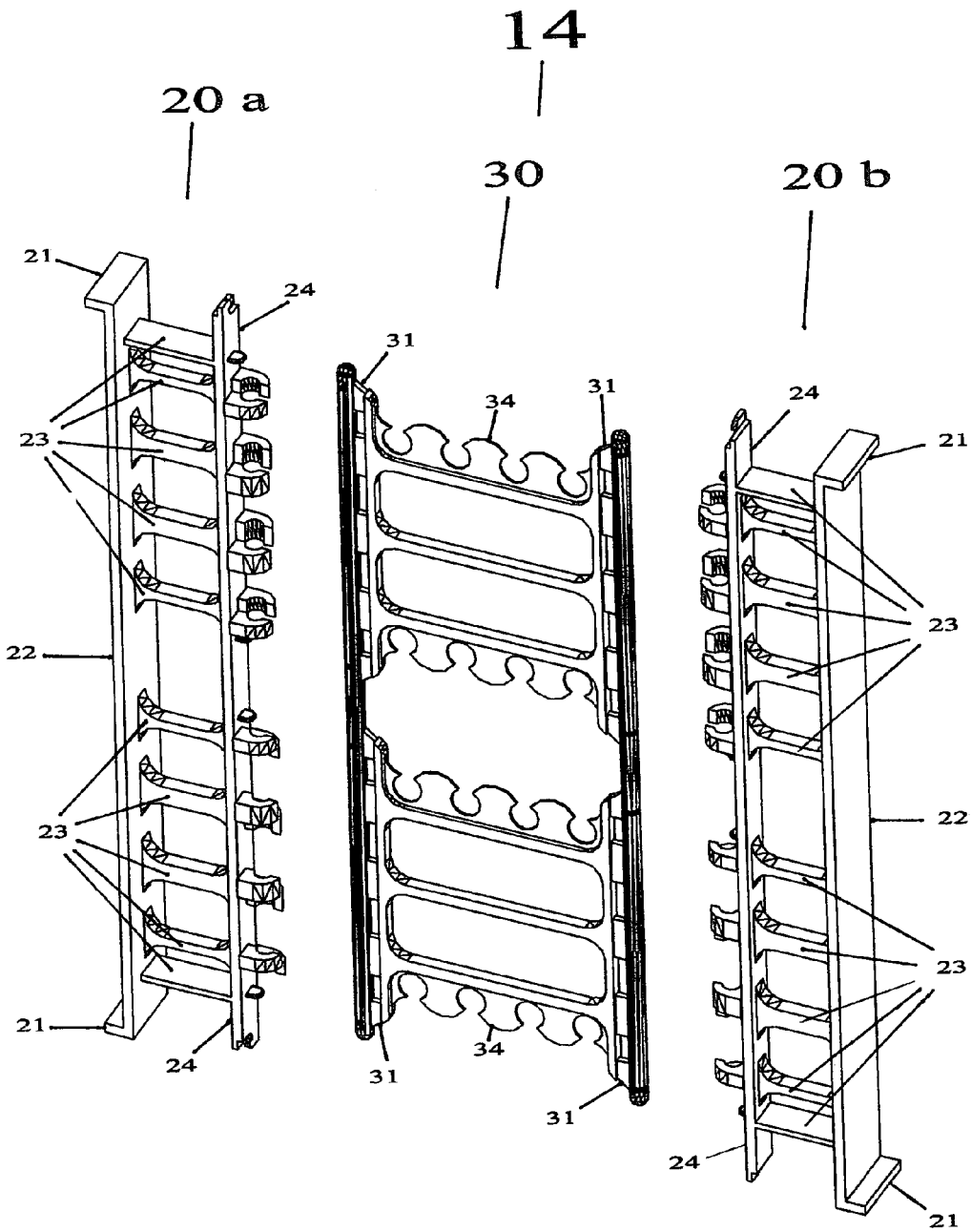
FIG. 3*a* is a perspective view of the individual sections of a complete bridging web in accordance with the present invention.
Figure 3B:
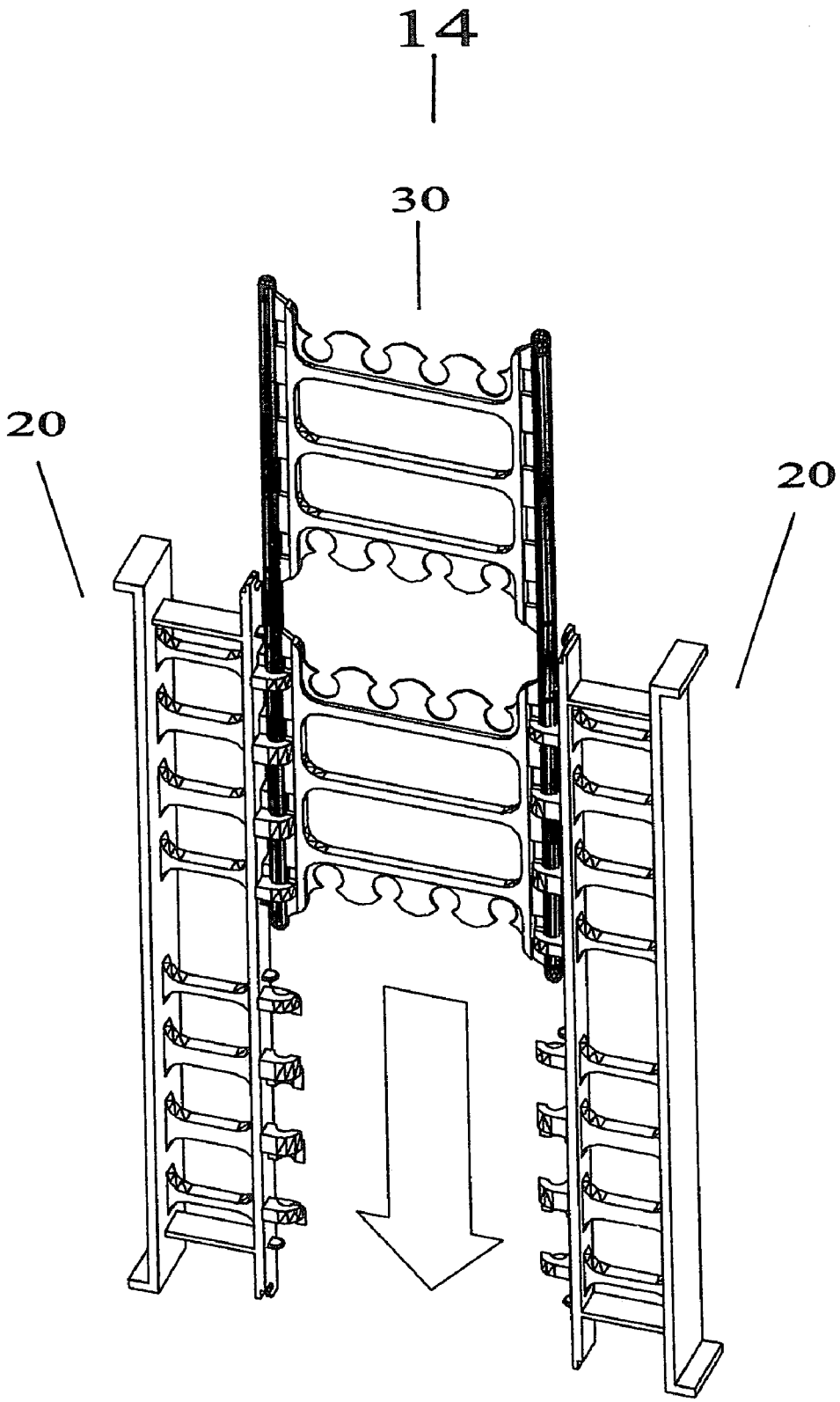
FIG. 3*b* is a perspective view of the connecting web showing the insertion of the central section.
Figure 9A:
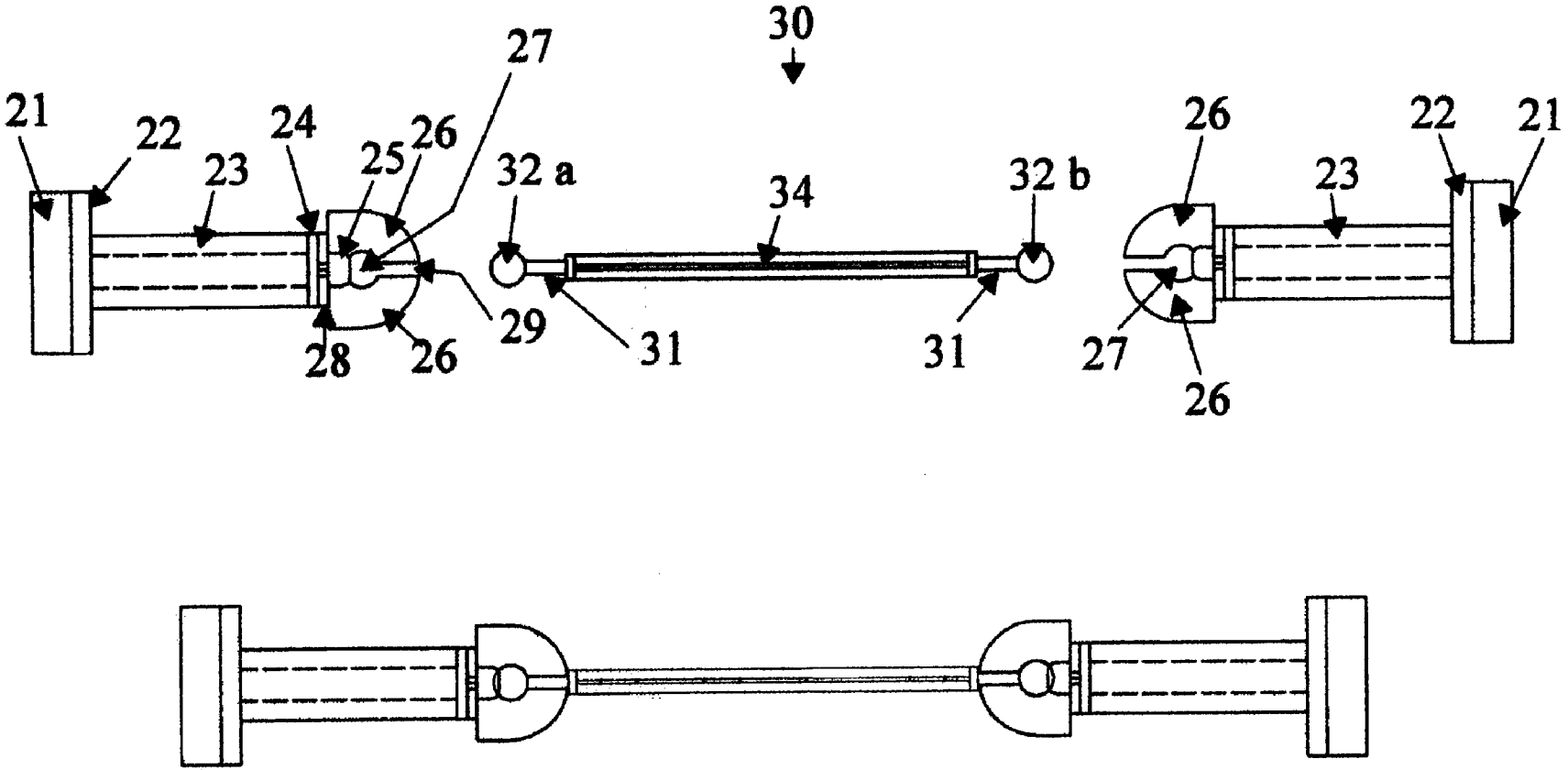
FIG. 9*a* is a top plan view of the bridging web of FIG. 3*a;*
Figure 9B:
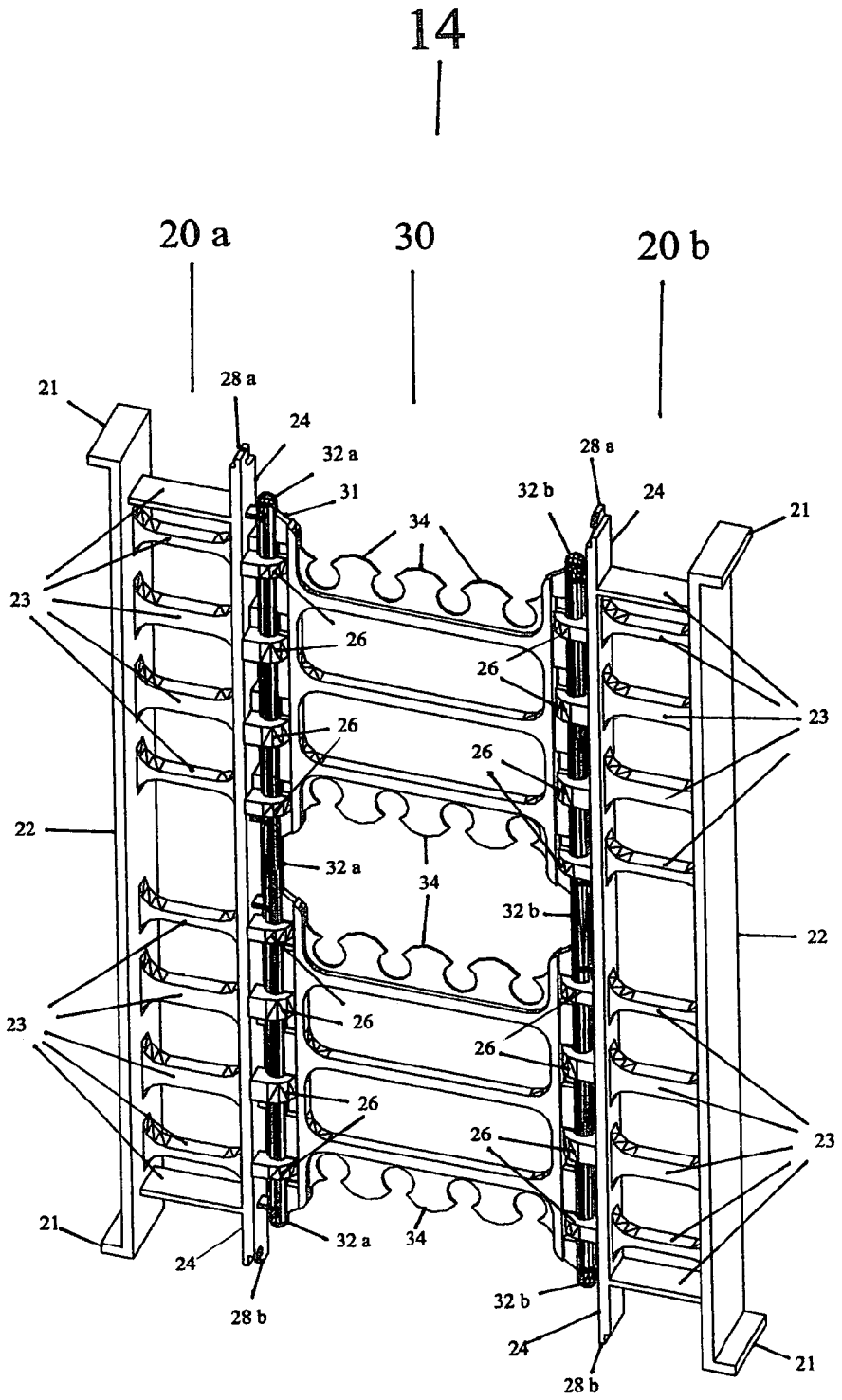
FIG. 9*b* is a perspective view of the three sections of the bridging web in an assembled state.

Referring now to FIG. 3*a*, FIG. 3*b* and FIG. 9*b*, each bridging web 14 comprises a pair of end-sections 20*a* and 20*b*. End section 20*a* is embedded in the first foam panel 12*a* and each end section 20*b* is embedded in the second foam panel 12*b*. Each end-section 20 has an elongated main plate 22 extending longitudinally and deep inside the foam panel 12. Parallel to the main plate 22 and extending flush with the inner surface 6 of the foam panel 12 is a connector plate 24, which is connected to the main plate 22 by a series of longitudinal elongated link elements 23. Attached to each end of the main plate 22 are bearing plates 21, which are flush with the top and bottom surfaces 2 and 4 respectively and extend to the outer surface 8 of the panel 12.

Figure 1C:
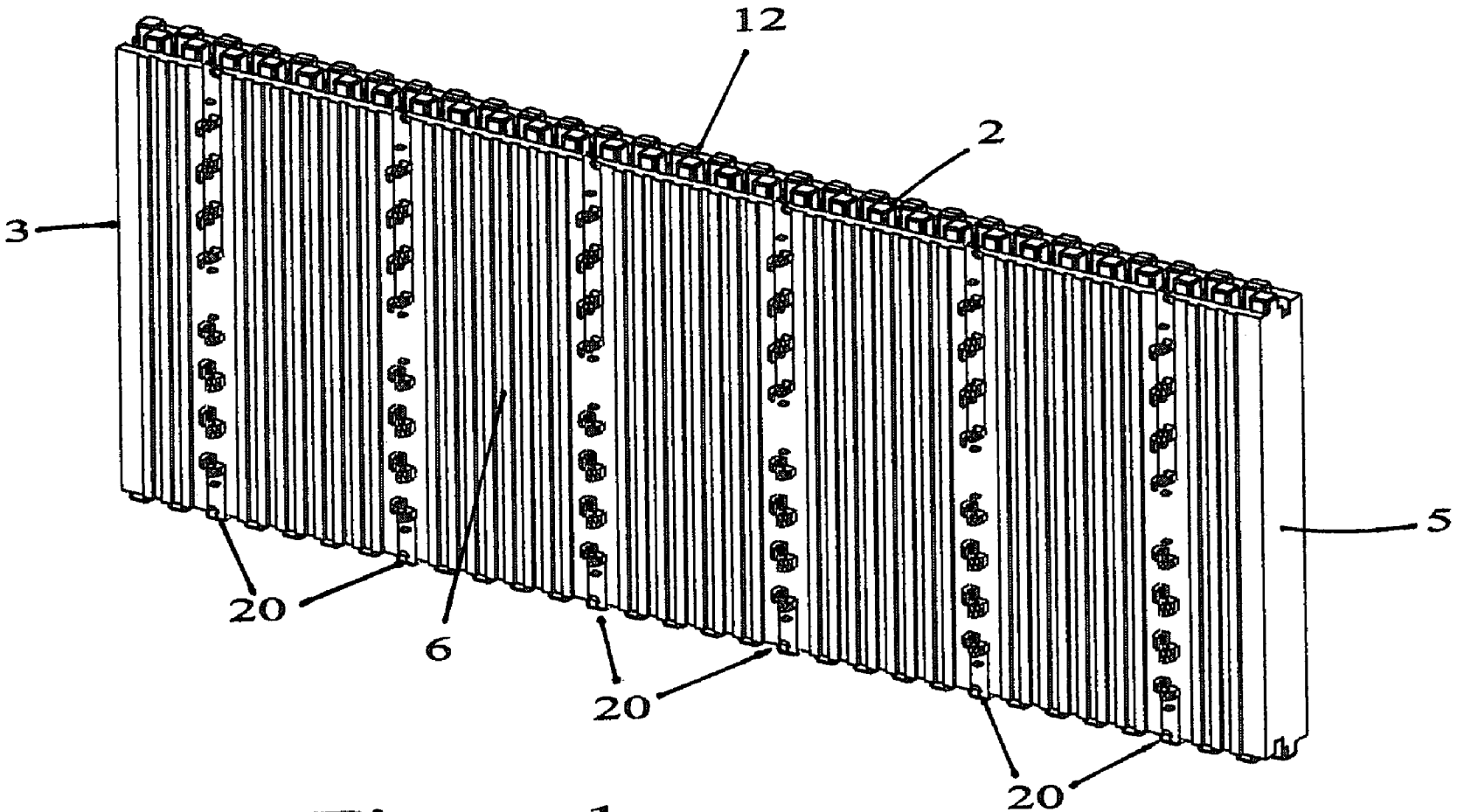
FIG. 1*c* is a perspective view of the inner surface of a single wall panel of the building component of FIG. 1*a;*

In the making of the foam panel 12 in the manufacturing plant, the plastic foam material forming the panel 12 is injected to surround the end sections 20*a* and 20*b*, thereby strengthening the joint between the panel 12 and the end sections 20*a* and 20*b* which thus act as anchor members forming part of the foam panel 12. More specifically and as best seen in FIG. 1*c* and FIG. 2*a*, the foam material from which wall panels 12 are formed, which is preferably polystyrene, is injected to surround the anchor member 20 such that the connector plate 24 of the end-section 20 is flush with the inner surface 6 of the foam panel 12.

Referring also to FIG. 3*a*, FIG. 3*b*, FIG. 5 and FIG. 9*b*, the bridging web 14 further comprises a central web member 30 extending between the foam panels 12. The central-web section or member 30, which is preferably made of a relatively flexible polypropylene, comprises a central portion 34 having a shape adapter to receive and hold metal bars/rods used to reinforce the concrete. The central-web member 30 further has a first longitudinal side-end 32*a* connected by a hinge 26 (described below) to the connector plate 24 of the first end-section 20*a* and a second longitudinal side-end 32*b* opposed to the first longitudinal side-end 32*a*. The second longitudinal side-end 32*b* is connected by hinges 26 to the connector plate 24 of the second end-section 20*b*. The foam panels 12 are movable between an extended position, as shown in FIG. 1*a*, where the foam panels 12 are spaced apart to make the block, and a partially collapsed position, as shown in FIG. 6, where the foam panels 12 are brought close to each other to illustrate this function.

Figure 4:
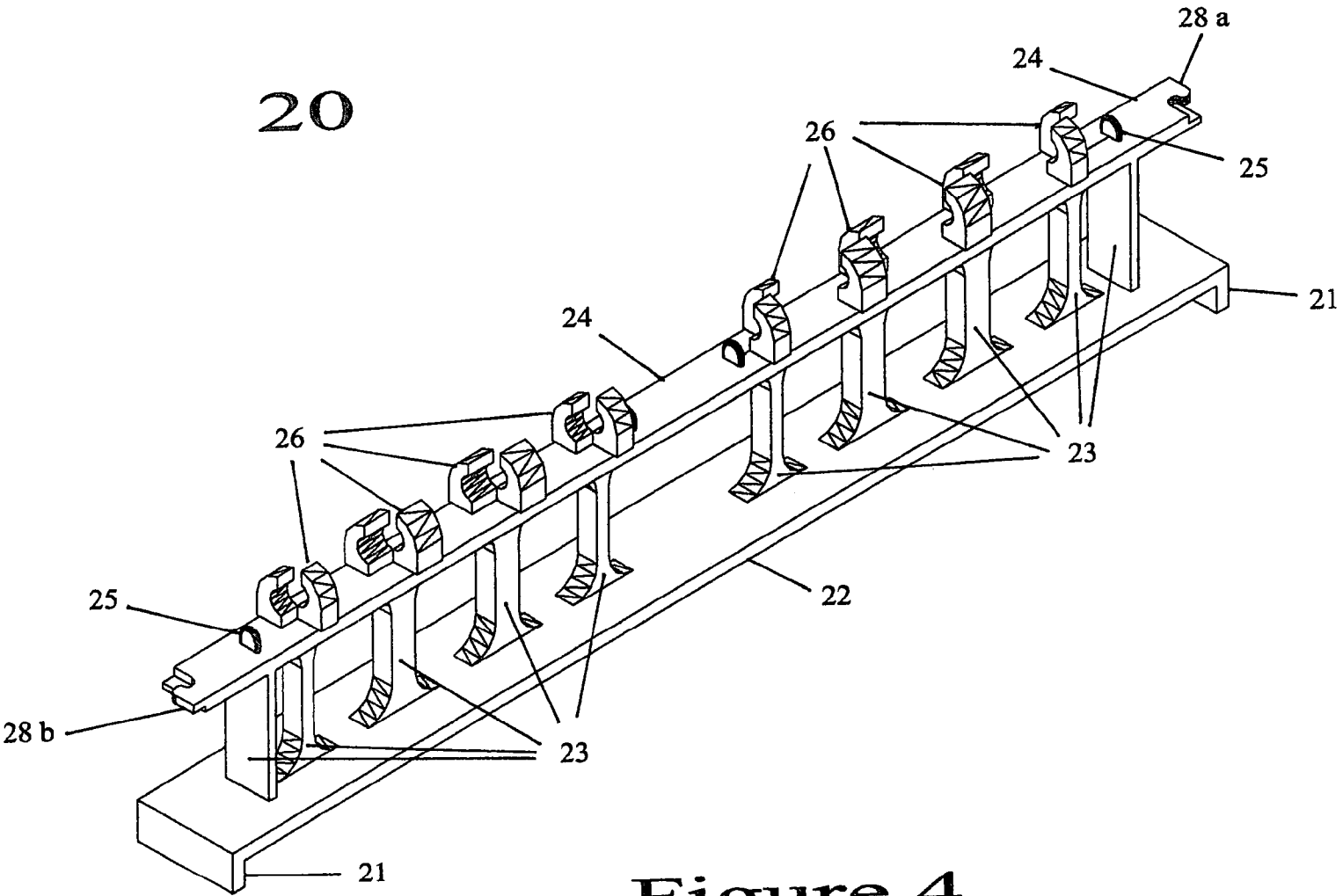
FIG. 4 is a perspective view of the end-section of the bridging web illustrating the detailed arrangement of the alternate half-tube hinges.

As shown in FIG. 4, in order to connect the central-web member 30 to the end-section 20, the bridging web 14 preferably comprises a plurality of aligned open-slotted half-tube hinges or knuckles 26 positioned on the connector plate 24. The half-tube hinges 26 are positioned such that the half tube hinges that face in opposite directions are staggered vertically from one another. This allows for end section 20 to be formed within a single injection mold. If the half tube hinges were not staggered from one another, it would be very difficult to form the end section 20 within an injection mold as the inner tube 27 defined by half-tube hinges 26 could not be formed, as that section would lie between the corresponding molds. With the configuration shown, the inner tube 27 can be formed by pressing the opposing mold against the inner curves of half tube hinges 26.

Figure 5:
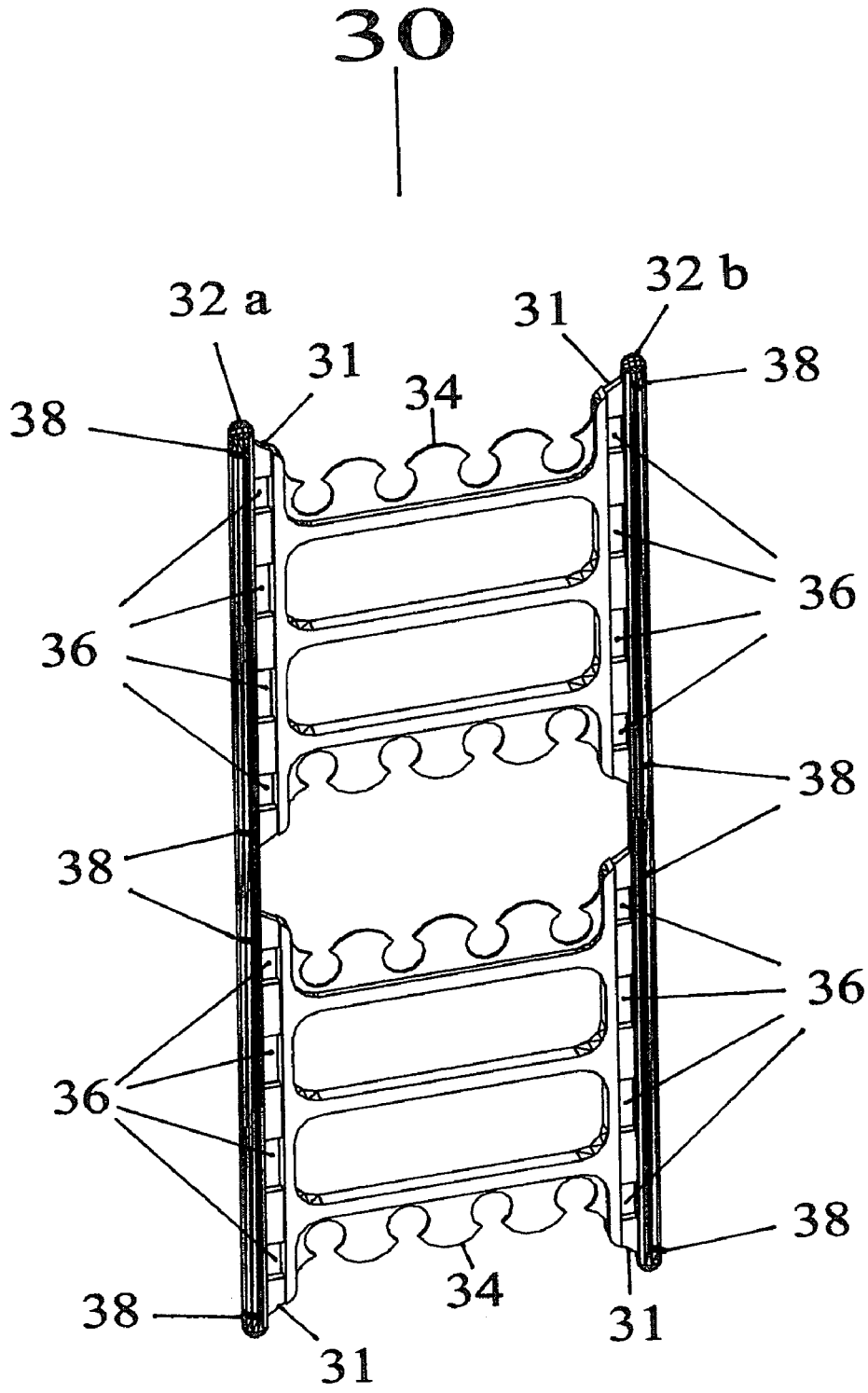
FIG. 5 is a perspective view of the central section of the bridging web of FIG. 3*a;*
Figure 7:
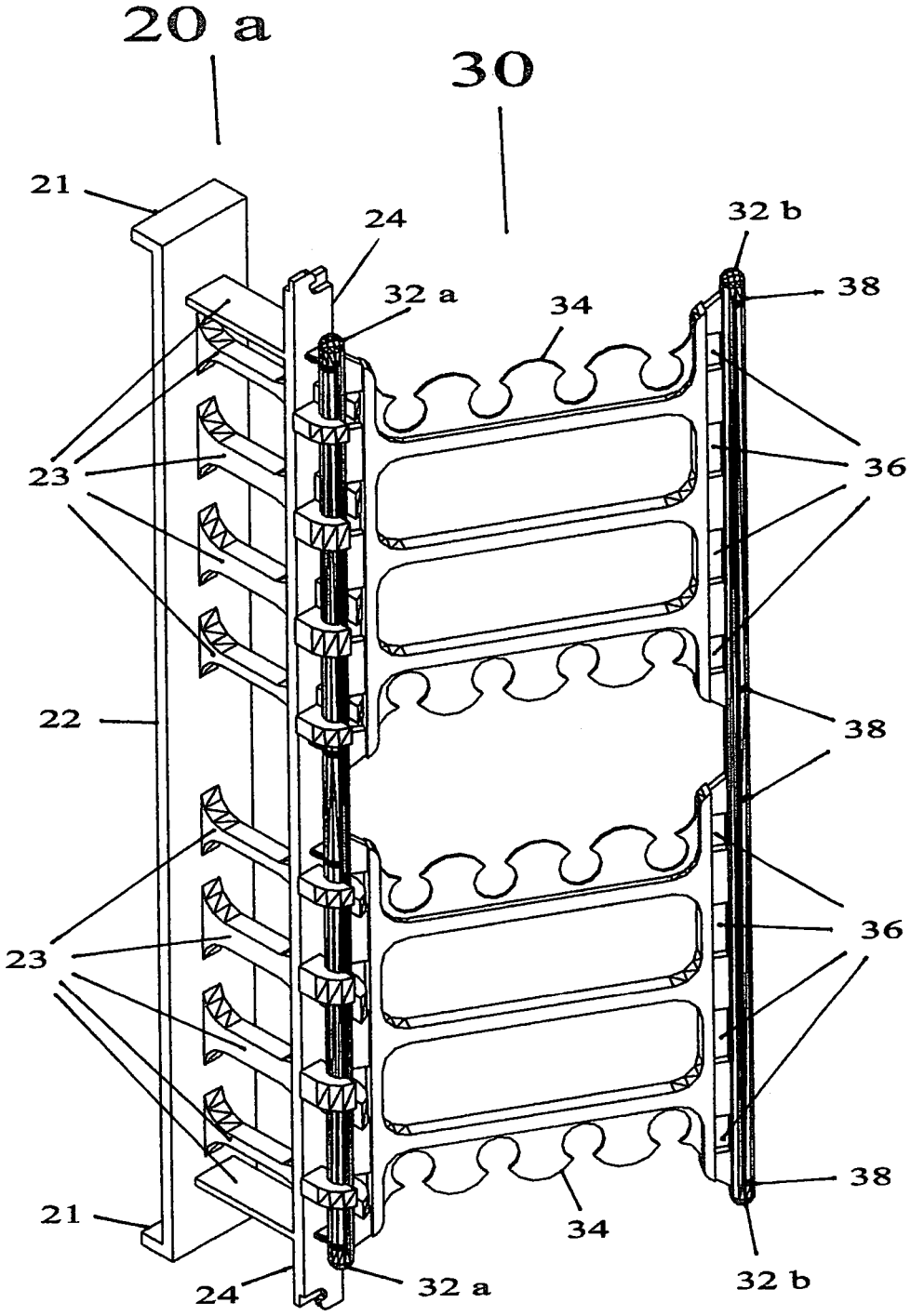
FIG. 7 is a perspective view of one end-section and the central-section of the bridging web in a pivoted position.
Figure 8:
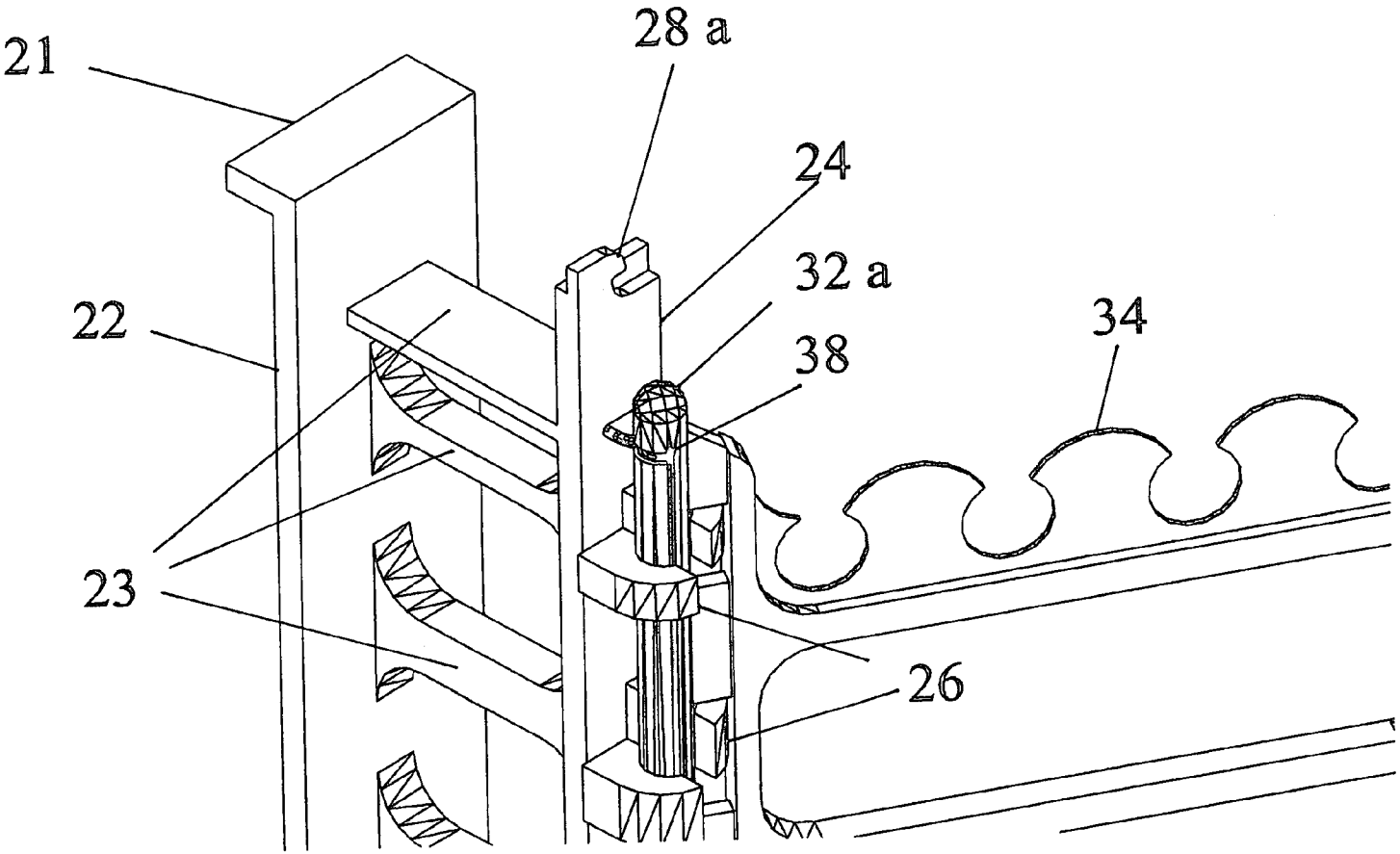
FIG. 8 is an enlargement of the upper portion of FIG. 7.

The half-tube hinged sections facing inward are designed to form series of slotted hinges for inserting the longitudinal sides 32*a* and 32*b* of the central section 30 to form a pivoting hinge between end-section 20 and central section 30. As best seen in FIGS. 9*a* and FIG. 9*b*, each pair of half-tube hinges 26 forms an inner tube 27 defining a slot 29 in registry with the slots of the other pairs of half tube hinges, as shown in FIG. 4. Each longitudinal side end 32 of the central web 30 defines a pin, which is sized to fit the inner tube 27 by inserting it through the slotted half-tube hinges 26 as shown in FIG. 3*b*. Referring to FIG. 5, FIG. 9*a* and FIG. 9*b*, each longitudinal side-end 32 of the central-web member 30 further defines a strip portion 31 connecting the longitudinal side 32 to a central portion 34 of the central section 30. The thickness of the strip portion 31 is such that the strip portion 31 fits through the longitudinal slots 29 defined by the ends of hinge elements 26. As best seen in FIG. 5, the strip portion 31 also includes a plurality of aligned slits 36 each adapted to receive a pair of half-tube hinges 26, thereby allowing the web-member 30 and the end section 20 to pivot with respect to each other, as shown in FIG. 7 and FIG. 8. The preferred embodiment of the present invention comprises eight pairs of half-tube hinges 26 on each end-section 20 and having eight corresponding slits 36 provided on the web member 30.

Referring more particularly to FIG. 8, the bridging web 14 preferably includes a stopper to prevent the web-member 30 from sliding out upwardly or downwardly of the knuckles 26 of the end-section 20. A series of grooves 38 are positioned along each of the longitudinal sides 32 at four locations as shown in FIG. 5, while leaf elements 25 are positioned on the connector plate 24 in four places. When the longitudinal sides 32 of the central web section 30 are inserted into the hinge sections 26 of the embedded end-sections 20, the four leaf elements 25 slide into the four grooves 38, locking and holding the central web-section 30 into proper position vis-á-vis the embedded end-sections 20.

Figure 10A:
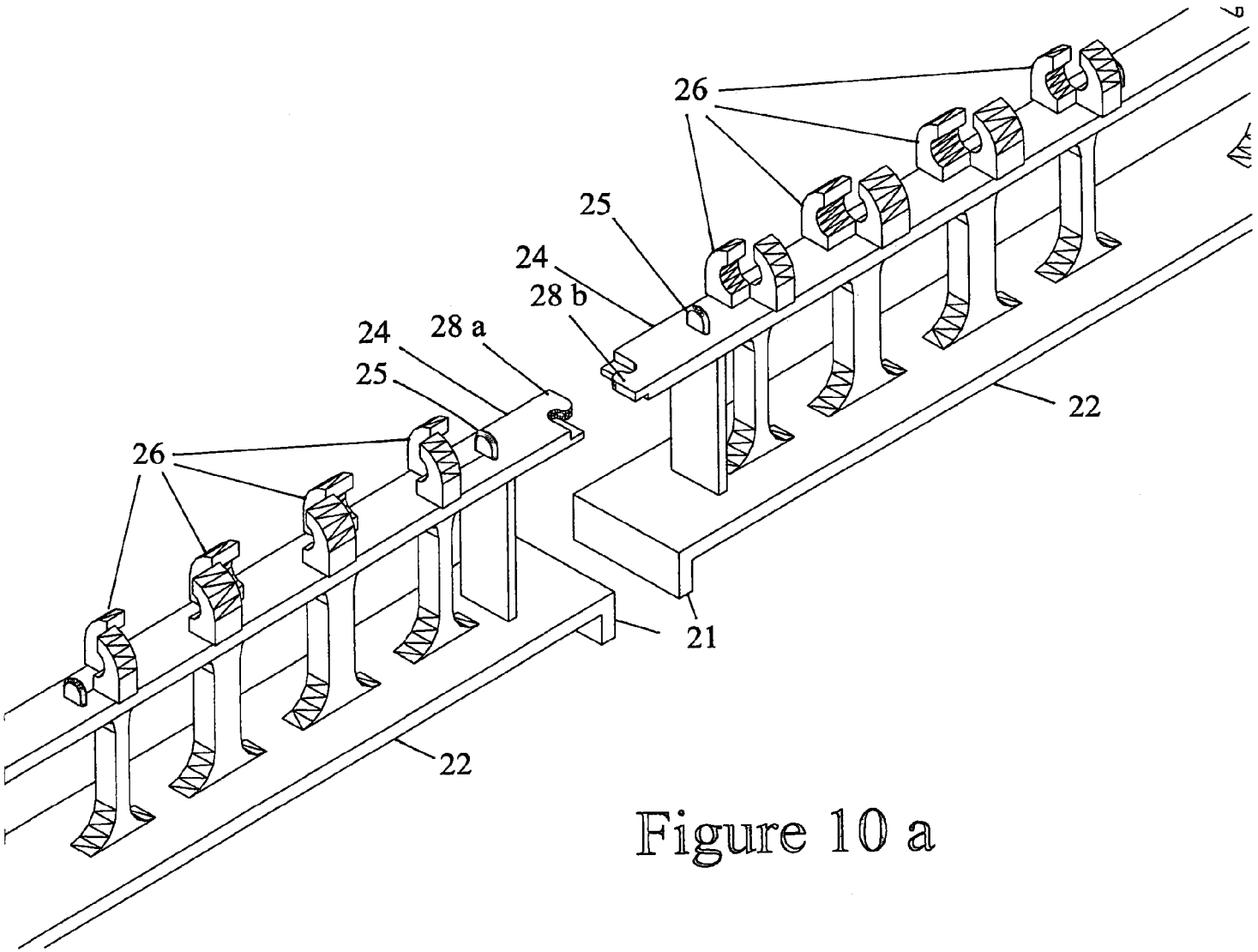
FIG. 10*a* is a perspective view of the upper end of a first end section and a lower end of a second end section prior to being connected; and, FIG. 10*b* is a perspective view of the ends sections of FIG. 10*a* connected to one another.
Figure 10B:
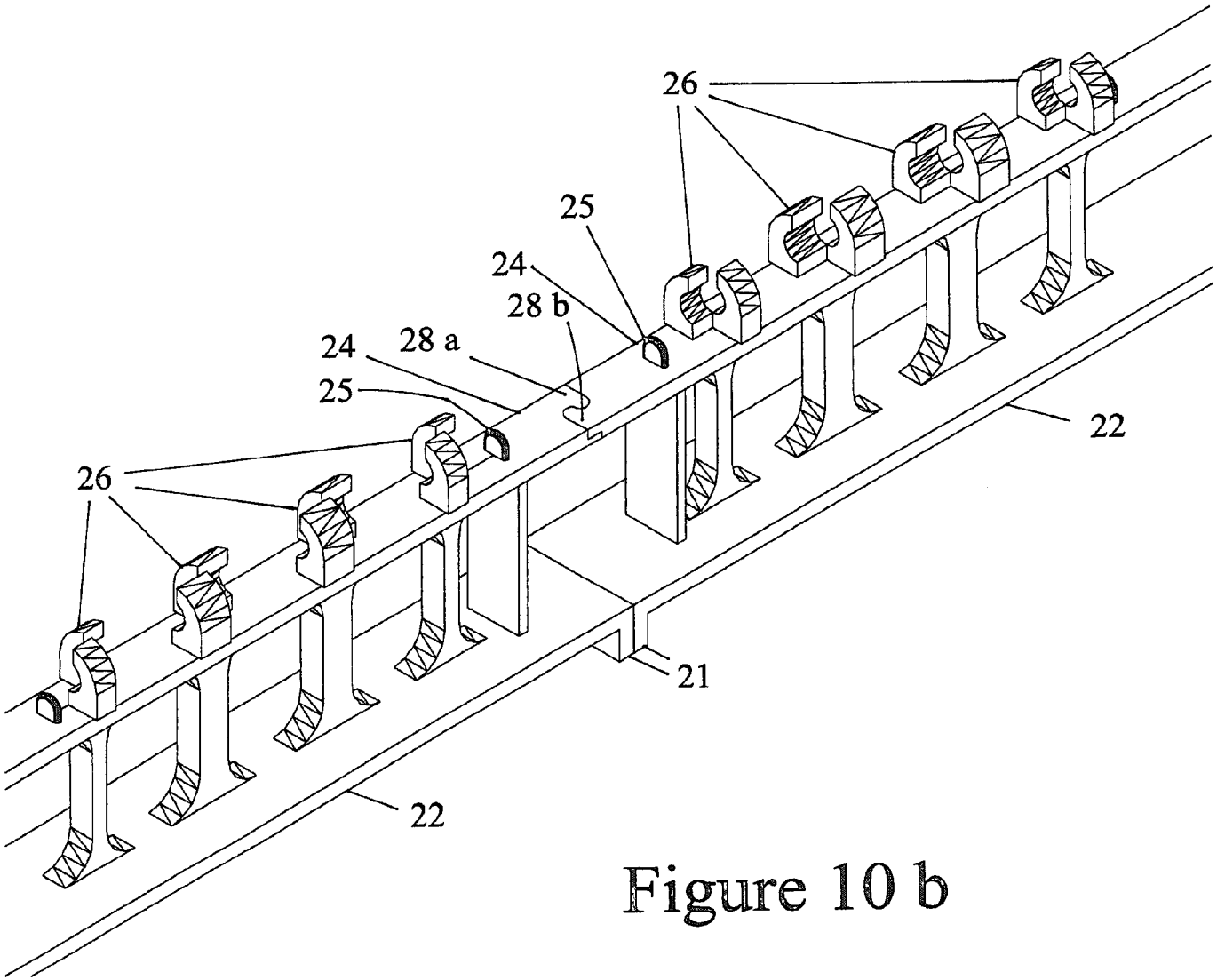

Referring to FIG. 4, FIG. 10*a* and FIG. 10*b*, the connector plate 24 of each end section 20 preferably comprises an upper end and a lower end both comprising a fastener 28*a* and 28*b*, respectively, to link the end section 20 to a second end section 20, as best seen in FIGS. 10*a* and 10*b*. More preferably, the fastener 28 is a grapnel-type hook molded on the end of the connector plate 24 with an extremity projecting from the end of the connector plate 24. FIG. 10*a* illustrates corresponding fasteners 28 separated while FIG. 10*b* illustrates corresponding fasteners 28 connected to one another. The grapnel hook 28*a* linked to the upper end of the connector plate 24 is in mirror symmetry with the grapnel hook 28*b* of the lower end of a second connector plate 24. Each fastener 28 of the end-section 20 is preferably shaped so that the projecting part of the fastener 28*a* fits flush into the cavity of fastener 28*b* of the mating end-section 20 as illustrated in FIG. 10*b*.

The interlocking mechanism is comprised of the checkerboard-type relief of the top and bottom surfaces of the panels 12 and the interlocking connection of fasteners 28. Wall forms can this be easily stacked over each other and linked together, as shown in FIG. 2*b*, to form a stable wall-form unit.

As can be appreciated from FIGS. 6 and 7, because of the specific characteristics of the central web 30, the panels 12, once tied with the help of those bridging webs 14, are easily foldable with respect to one another and thus can be shipped to the site of construction in a well-compacted form.

Inasmuch as the preferred embodiment of the invention has been outlined herein in all possible details and illustrated with various accompanying drawings, it must be emphasized that the invention is not limited to this precise embodiment and that possible various changes and modifications may be introduced therein without affecting the concept or the intent of this invention.

The invention claimed is:

1. A bridging web for linking a first and second wall panel, the first and second wall panels extending parallel to one another, the bridging web comprising:

a first and second end member, each of said end members extending between a first edge mountable within the wall panels and a second edge, said second edge having a first hinge element, said first end member being mountable within said first wall panel and said second end member being mountable within said second wall panel; and a central section extending between a pair of second hinge elements, said central section being mountable between said first hinge element of said first end member and said first hinge element of said second end member;

wherein one of said first and second hinge elements is a pin and the other of said first and second hinge elements includes at least one first knuckle and at least one second knuckle, said pin defining a vertical hinge axis, said first knuckle being vertically displaced from said second knuckle, said first and second knuckles being adapted to bear on opposing surfaces of said pin.

2. A bridging web as claimed in claim 1, further comprising a stop member, said stop member being adapted to maintain said first hinge element at a fixed vertical position with respect to said second hinge element.

3. A bridging web as claimed in claim 1, wherein said first hinge element is a pin.

4. A bridging web as claimed in claim 1, wherein said second hinge element is a pin.

5. A bridging web as claimed in claim 4, wherein said second edge of said end members is a connecting plate, said first and second knuckles being affixed to said connecting plate.

6. A bridging web as claimed in claim 5, wherein said connecting plate has an upper end, a lower end, a first connector mounted to said upper end and a second connector mounted to said lower end, said first connector being adapted to connect to said second connector of an adjoining end member.

7. A bridging web as claimed in claim 1, wherein the other of said first and second hinge elements includes a plurality of first and second knuckles, each of said first knuckles being vertically displaced from each of said second knuckles.

8. A bridging web as claimed in claim 7, wherein said first knuckles and said second knuckles are positioned in a vertically alternating pattern.

9. A building component comprising:

First and second panels, each of said panels having an inner surface and an outer surface, said panels arranged in a spaced parallel relationship with said inner surfaces facing each other, and a plurality of bridging webs extending between said panels, tying said first panel to said second panel, each bridging web comprising:

a first and second end member, each of said end members extending between a first edge mounted within said panel and a second edge proximate to said inner surface, said second edge having a first hinge element, said first end member being mounted within said first panel and said second end member being mounted within said second wall panel; and a central section extending between a pair of second hinge elements, one of said second hinge elements being mounted to said first hinge element of said first end member, the other of said second hinge elements being mounted to said first hinge element of said second end member;

wherein one of said first and second hinge elements is a pin and the other of said first and second hinge elements includes at least one first knuckle and at least one second knuckle, said pin defining a vertical hinge axis, said first knuckle being vertically displaced from said second knuckle, said first and second knuckles being adapted to bear on opposing surfaces of said pin.

10. A building component as claimed in claim 9, wherein each bridging web further comprises a stop member, said stop member being adapted to maintain said first hinge element at a fixed vertical position with respect to said second hinge element.

11. A building component as claimed in claim 9, wherein said first hinge element is a pin.

12. A building component as claimed in claim 9, wherein said second hinge element is a pin.

13. A building component as claimed in claim 12, wherein said second edge of said end members is a connecting plate, said first and second knuckles being affixed to said connecting plate.

14. A building component as claimed in claim 13, wherein said connecting plate has an upper end, a lower end, a first connector mounted to said upper end and a second connector mounted to said lower end, said first connector being adapted to connect to said second connector of an adjoining end member.

15. A building component as claimed in claim 9, wherein the other of said first and second hinge elements includes a plurality of first and second knuckles, each of said first knuckles being vertically displaced from each of said second knuckles.

16. A building component as claimed in claim 15, wherein said first knuckles and said second knuckles are positioned in a vertically alternating pattern.

* * * * *